US005158060A

United States Patent [19]

Hara

[11] Patent Number: 5,158,060

[45] Date of Patent: Oct. 27, 1992

[54] ENGINE LOAD PARAMETER-CALCULATING SYSTEM AND ENGINE CONTROL SYSTEM USING THE CALCULATING SYSTEM

[75] Inventor: Fumio Hara, Wako, Japan

[73] Assignee: Honda Giken Kogyo Kabushiki Kaisha, Tokyo, Japan

[21] Appl. No.: 739,354

[22] Filed: Aug. 2, 1991

[30] Foreign Application Priority Data

Aug. 22, 1990 [JP] Japan ..... 2-221925

[51] Int. Cl.[5] ..... F02D 41/04

[52] U.S. Cl. ..... 123/494; 123/492; 123/493

[58] Field of Search ..... 123/478, 480, 486, 492, 123/493, 494

[56] References Cited

U.S. PATENT DOCUMENTS 4,561,404 12/1985 Kanno et al. ..... 123/494 X
4,873,641 10/1989 Nagaishi et al. ..... 123/494 X
4,892,072 1/1990 Miwa et al. ..... 123/494 X
4,951,209 8/1990 Nagaishi et al. ..... 123/492 X
4,967,715 11/1990 Hosaka ..... 123/494

FOREIGN PATENT DOCUMENTS 63-143348 6/1988 Japan .

*Primary Examiner*—Willis R. Wolfe
*Attorney, Agent, or Firm*—Nikaido, Marmelstein, Murray & Oram

[57] ABSTRACT

An engine load parameter-calculating system for an internal combustion engine calculates an engine load parameter indicative of an amount of intake air drawn into the engine. The system determines a value of an opening area formed by a throttle valve and reflecting an amount of intake air, a reference value of the opening area in accordance with the rotational speed of the engine, and a value of the engine load parameter from the value of the opening area and the reference value of same. An engine control system calculates a basic control amount for controlling the engine by the use of the value of the engine load parameter.

11 Claims, 9 Drawing Sheets

ENGINE LOAD PARAMETER-CALCULATING SYSTEM AND ENGINE CONTROL SYSTEM USING THE CALCULATING SYSTEM

BACKGROUND OF THE INVENTION

This invention relates to an engine load parameter-calculating system, and an engine control system using the engine load parameter-calculating system.

Conventionally, a method has been proposed by Japanese Provisional Patent Publication (Kokai) No. 63-143348, which comprises steps of detecting an amount of air drawn into an internal combustion engine by an intake air amount sensor or an intake pressure sensor, and controlling a fuel supply amount, ignition timing, etc. in accordance with the detected value of the amount of air drawn into the engine. When the engine is in a transient operating condition, a proper control amount cannot be obtained due to delay in detection of the amount of air by the intake air amount sensor or the intake pressure sensor. Therefore, according to the above method, when the engine is in a transient operating condition, an estimated value of intake pressure is obtained from detected values of throttle valve opening and the engine rotational speed, and a control amount is obtained based on the estimated value of intake pressure.

However, according to this prior art, estimated values of intake pressure are stored in a storage device in the form of a map set in accordance with values of the throttle valve opening and the engine rotational speed. To obtain an accurate estimated value of intake pressure, the map is required to have many finely divided values (lattice points) of the throttle valve opening and the engine rotational speed. This requires the use of a storage device with a very large capacity. Further, it takes a longer time period to determine a control amount from such a very large amount of stored data, which results in degraded controllability of the engine.

SUMMARY OF THE INVENTION

It is a first object of the invention to provide an engine load parameter-calculating system which is capable of quickly calculating a parameter which is accurately indicative of load on the engine when it is in a transient operating condition, without requiring a very large amount of stored data.

It is a second object of the invention to provided an engine control system using the engine load parameter-calculating system.

To attain the first object of the invention, according to a first aspect of the invention, there is provided an engine load parameter-calculating system for an internal combustion engine having an intake passage, and a throttle valve arranged in the intake passage, the system calculating an engine load parameter indicative of an amount of intake air drawn into the engine.

The engine load parameter-calculating system according to the first aspect of the invention is characterized by comprising:

opening area value-determining means for determining a value of an opening area formed by the throttle valve;

reference area value-determining means for determining a reference value of the opening area formed by the throttle valve in accordance with a rotational speed of the engine; and engine load parameter-determining means for determining a value of the engine load parameter from the value of the opening area formed by the throttle valve and the reference value of the opening area formed by the throttle valve.

Preferably, the engine load parameter-determining means includes area ratio-calculating means for calculating a ratio between the value of the opening area formed by the throttle valve and the reference value, the value of the engine load parameter being determined based on the ratio.

To attain the second object of the invention, according to a second aspect of the invention, there is provided an engine control system for an internal combustion engine including an intake passage, a throttle valve arranged in the intake passage, and an engine load parameter-calculating system for calculating an engine load parameter indicative of an amount of intake air drawn into the engine.

The engine control system according to the second aspect of the invention is characterized by comprising basic control amount-calculating means for calculating a basic control amount for controlling the engine by the use of the value of the engine load parameter determined by the engine load parameter-determining means.

Preferably, the engine control system includes an engine load sensor for detecting the engine load parameter, and transient operating condition-determining means for determining whether or not the engine is in a transient operating condition, and the basic control amount-calculating means calculates the basic control amount by the use of a value of output from the engine load sensor when the transient operating condition-determining means has determined that the engine is not in the transient operating condition.

More preferably, the engine load sensor detects pressure within the intake passage at a location downstream of the throttle valve.

Alternatively, the engine load sensor detects an amount of air drawn into the engine.

Preferably, the engine control system includes difference-calculating means for calculating a difference between a value of output from the engine load sensor and the value of the engine load parameter determined by the engine load parameter-determining means, when the transient operating condition-determining means has determined that the engine is not in the transient operating condition, and the basic control amount-calculating means corrects the value of the engine load parameter determined by the engine load parameter-determining means, by the difference from calculating the basic control amount, when the transient operating condition-determining means has determined that the engine is in the transient operating condition.

To attain the first object of the invention, according to a third aspect of the invention, there is provided an engine load parameter-calculating system for an internal combustion engine having an intake passage and a throttle valve arranged in the intake passage, the system calculating an engine load parameter indicative of an amount of intake air drawn into the engine, the system comprising:

throttle valve opening-detecting means for detecting a value of angle assumed by the throttle valve;

reference value-determining means for determining a reference value of the angle of the throttle valve in accordance with a rotational speed of the engine; and engine load parameter-determining means for determining a value of the engine load parameter indicative of the amount of intake air, from the detected value of the angle assumed by the throttle valve and the reference value of the angle assumed by the throttle valve.

Preferably, the engine load parameter-determining means includes means for calculating a ratio between the value of the angle assumed by the throttle valve and the reference value of the angle assumed by the throttle valve, the engine load parameter being determined based on the ratio.

To attain the second object of the invention, according to a fourth aspect of the invention, there is provided an engine control system for an internal combustion engine including an intake passage, a throttle valve arranged in the intake passage, and the engine load parameter-calculating system according to the third aspect of the invention, the engine control system comprising basic control amount-calculating means for calculating a basic control amount for controlling the engine by the use of the value of the engine load parameter obtained by the engine load parameter-determining means.

The above and other objects, features, and advantages of the invention will become more apparent from the ensuing detailed description taken in conjunction with the accompanying drawings.

DETAILED DESCRIPTION

The invention will now be described in detail with reference to the drawings showing an embodiment thereof.

Figure 1:
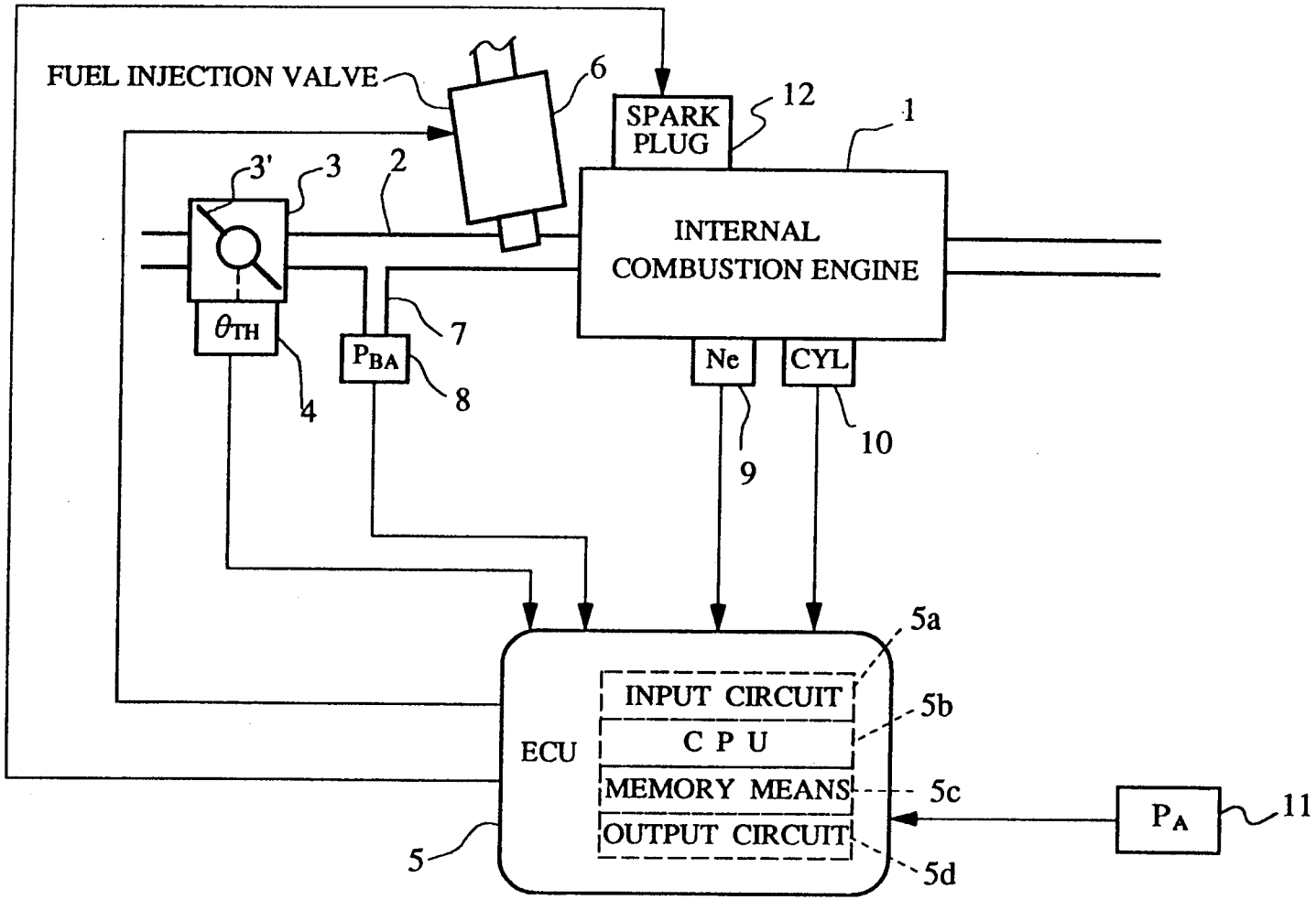
FIG. 1 is a schematic diagram showing the whole arrangement of an engine control system according to an embodiment of the invention.

Referring first to FIG. 1, there is shown the whole arrangement of an engine control system according to the embodiment of the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening (the angle assumed in the throttle valve 3') and supplying same to an electronic control unit (hereinafter called "the ECU") 5.

Fuel injection valves 6, only one of which is shown, are inserted into the interior of the intake pipe at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

Spark plugs 12, which are provided for respective cylinders of the engine 1, are electrically connected to the ECU 5 to have ignition timing $\theta_{IG}$ thereof controlled by a signal therefrom.

On the other hand, an intake pipe absolute pressure ($P_{BA}$) sensor 8 is provided in communication with the interior of the intake pipe 2 through a conduit 7 at a location immediately downstream of the throttle valve 3' for supplying an electric signal indicative of the sensed absolute pressure within the intake pipe 2 to the ECU 5.

An engine rotational speed (Ne) sensor 9 and a cylinder-discriminating (CYL) sensor 10 are arranged in facing relation to a camshaft or a crankshaft of the engine 1, neither of which is shown. The engine rotational speed sensor 9 generates a pulse as a TDC signal pulse at each of predetermined crank angles whenever the crankshaft rotates through 180 degrees, while the cylinder-discriminating sensor 10 generates a pulse at a predetermined crank angle of a particular cylinder of the engine, both of the pulses being supplied to the ECU 5.

An atmospheric pressure sensor 11 for detecting atmospheric pressure is electrically connected to the ECU 5, and supplies a signal indicative of the detected atmospheric pressure thereto.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5*b*, memory means 5*c* storing various operational programs which are executed in the CPU 5*b*, and for storing results of calculations therefrom, etc., and an output circuit 5*d* which outputs driving signals to the fuel injection valves 6.

The CPU 5*b* operates in response to the engine parameter signals from the sensors described above, and not shown, to determine operating conditions in which the engine 1 is operating, and calculates, based upon the determined operating conditions, the valve opening period or fuel injection period $T_{OUT}$ over which the fuel injection valves 6 are to be opened, by the use of the following equation (1) in synchronism with inputting of TDC signal pulses to the ECU 5:

$$T_{OUT} = T_i \times K_1 + K_2 \quad (1)$$

where $T_i$ represents a basic value (hereinafter referred to as "Ti value") of the fuel injection period $T_{OUT}$ of the fuel injection valves 6, which is read from a Ti map in which Ti values are set in accordance with the engine rotational speed Ne and the intake pipe absolute pressure $P_{BA}$. In retrieving the Ti value, there are used a value of the engine rotational speed Ne actually detected by the engine rotational speed sensor 9, and a value of the intake pipe absolute pressure $P_{BA}$ (hereinafter referred to as "detected $P_{BA}$ value") actually detected by the intake pipe absolute pressure sensor 8, or alternatively a calculated value of $P_{BA}$ (hereinafter referred to as "calculated PBA value") which is calculated in a program shown in FIG. 2, referred to hereinafter.

$K_1$ and $K_2$ are other correction coefficients and correction variables, respectively, which are calculated based on various engine parameter signals to such values as to optimize characteristics of the engine such as fuel consumption and driveability depending on operating conditions of the engine.

The CPU 5b further retrieves a basis value $\theta i$ (hereinafter referred to as "$\theta i$ value") of ignition timing $\theta_{IG}$ from an ignition timing map in which $\theta i$ values are set in accordance with the engine rotational speed Ne and the intake pipe absolute pressure $P_{BA}$. In retrieving a $\theta i$ value, there are used a value of Ne actually detected by the engine rotational speed sensor 9, and a detected $P_{BA}$ value, or alternatively, a calculated PBA value. The ignition timing $\theta_{IG}$ is calculated by correcting the $\theta i$ value in accordance with operating conditions of the engine.

The CPU 5b supplies through the output circuit 5d, the fuel injection valves 6 and the spark plug 12 with driving signals corresponding to the calculated fuel injection period $T_{OUT}$ and ignition timing $\theta i$ determined as above, respectively.

Figure 2A:
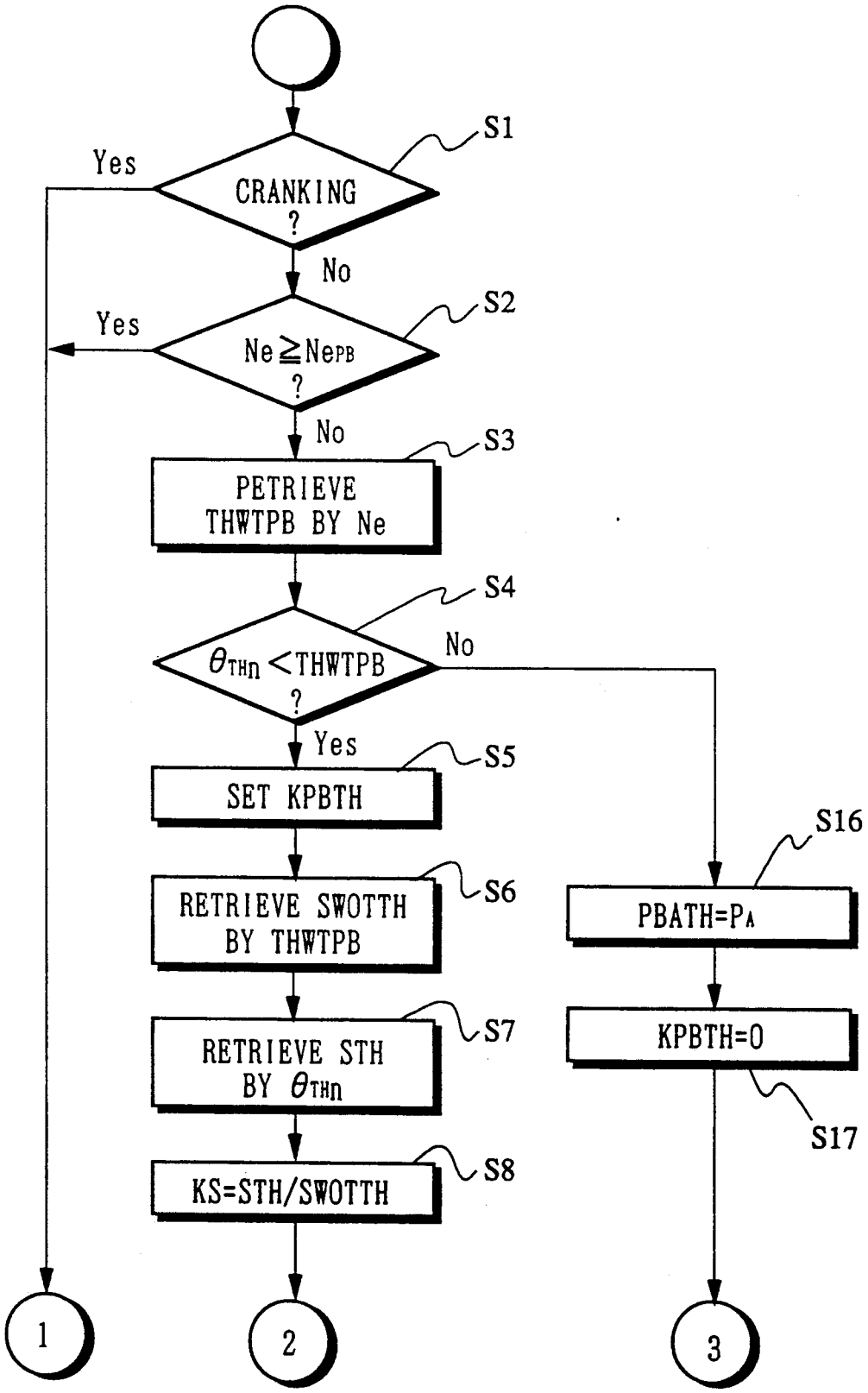
FIGS. 2*a*–2*c* are flowcharts of a program for calculating basic values of a fuel injection time period and ignition timing.
Figure 2B:
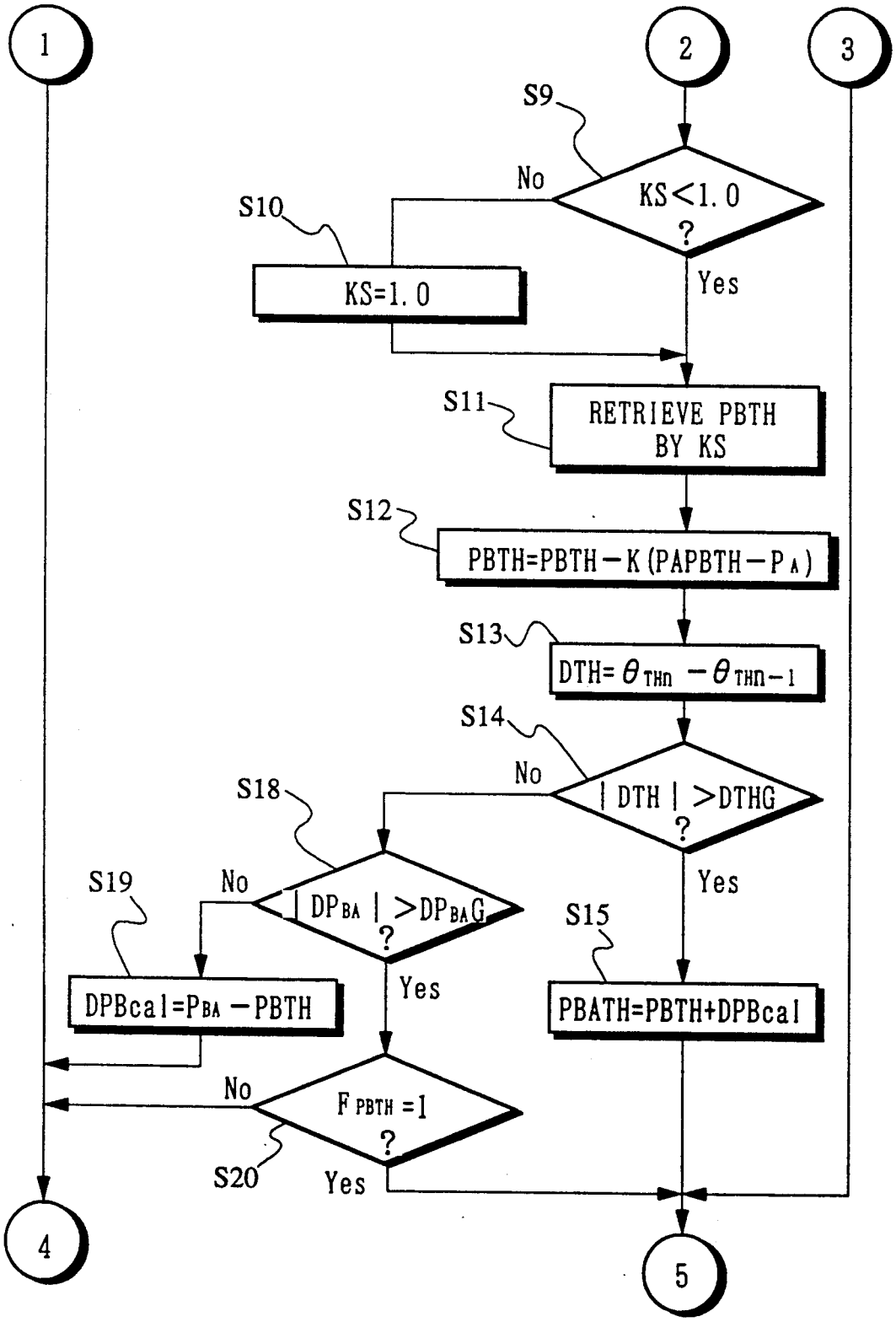
Figure 2C:
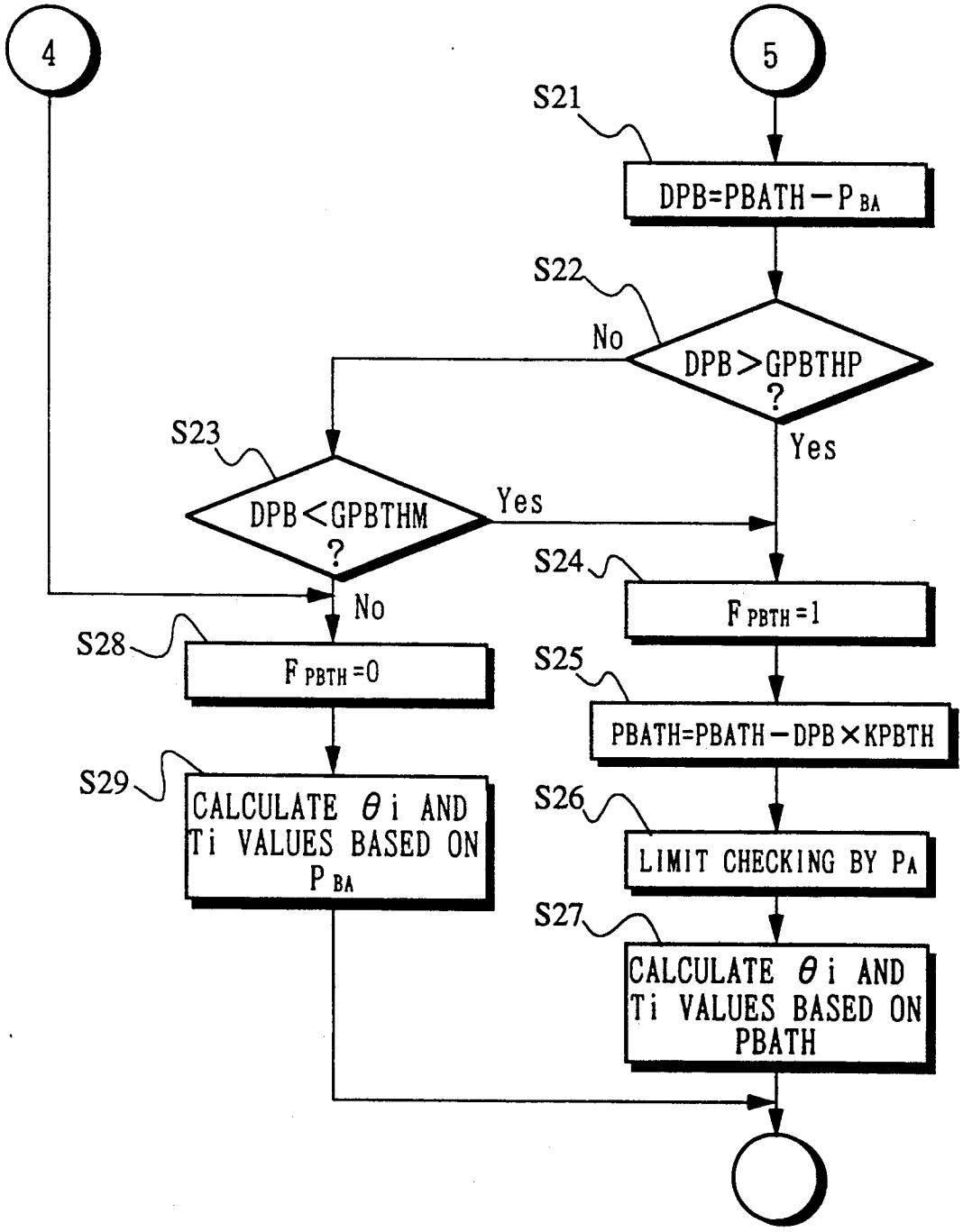

FIGS. 2a–2c show a program for calculating the Ti value and the $\theta i$ value.

At a step S1, it is determined whether or not the engine is cranking. If the answer to this question is affirmative (Yes), a flag $F_{PBTH}$ is set to a value of 0 at a step S28, and the $\theta i$ value and the Ti value are calculated by the use of the $P_{BA}$ value detected by the intake pipe absolute pressure sensor 8 and the engine rotational speed Ne at a step S29. The flag $F_{PBTH}$ is set to a value of 1 when the $\theta i$ and Ti values are calculated by the use of the calculated $P_{BA}$ value PBATH, as described hereinafter.

If the answer to the question of the step S1 is negative (No), i.e. if the engine is not cranking, it is determined at a step S2 whether or not the engine rotational speed Ne is equal to or higher than a predetermined value $Ne_{PB}$ (e.g. 4000 rpm). If the answer is affirmative (Yes), i.e. if $Ne \geqq Ne_{PB}$, the program proceeds to the step S28. When the engine rotational speed is high, detection of the $P_{BA}$ value in a transient operating condition of the engine is not delayed beyond a satisfactory level, which makes unnecessary the calculation of a value of $P_{BA}$ based on throttle valve opening $\theta_{TH}$.

Figure 3:
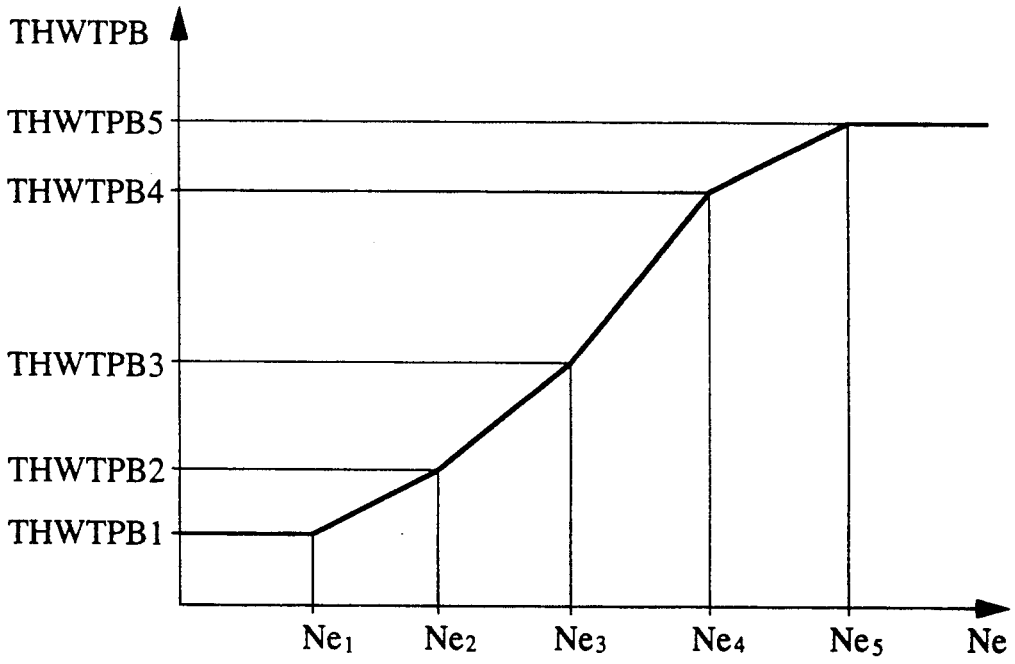
FIG. 3 is a view showing an Ne-THWTPB table.

If both the answers to the questions of the steps S1 and S2 are negative (No), i.e. if the engine is not cracking and at the same time $Ne < Ne_{PB}$, full load throttle valve opening THWTPB is calculated based on the engine rotational speed Ne at a step S3. The full load throttle valve opening THWTPB is the minimum value of throttle valve opening at which the intake pipe absolute pressure $P_{BA}$ assumes a value which is substantially the same as assumed when the throttle valve is fully opened. The full load throttle valve opening THWTPB is calculated by the use of a Ne-THWTPB table shown in FIG. 3. In FIG. 3, predetermined values THWTPB 1 to THWTPB 5 of the full load throttle valve opening are provided, which correspond to predetermined values $Ne_1$ to $Ne_5$, respectively. Values of the full load throttle valve opening THWTPB corresponding to values of the engine rotational speed falling between adjacent ones of the predetermined valves $Ne_1$ to $N_5$ are calculated by interpolation. As can be learned from the figure, the lower the engine rotational speed, the smaller the value of throttle valve opening at which there is obtained substantially the same value of $P_{BA}$ as assumed when the throttle valve is fully opened.

At a step S4, it is determined whether or not the present value $\theta_{TH}n$ of throttle valve opening detected in the present loop is smaller than a value of the full load throttle valve opening THWTPB calculated at the step S3. If the answer to this question is negative (No), i.e. if $\theta_{TH}n \geqq$ THWTPB, the calculated $P_{BA}$ value, referred to hereinafter, is set to atmospheric pressure $P_A$ at a step S16, since the intake pipe absolute pressure is then equal to a value assumed when the throttle valve is fully opened, and a correction coefficient KPBTH for use in calculation at a step S 25, referred to hereinafter, is set to a value of 0 at a step S17, followed by the program proceeding to a step S21. Alternatively, when the atmospheric pressure sensor is not provided, the calculated $P_{BA}$ value may be set to normal atmospheric pressure (760 mmHg) at the step S16.

Figure 4:
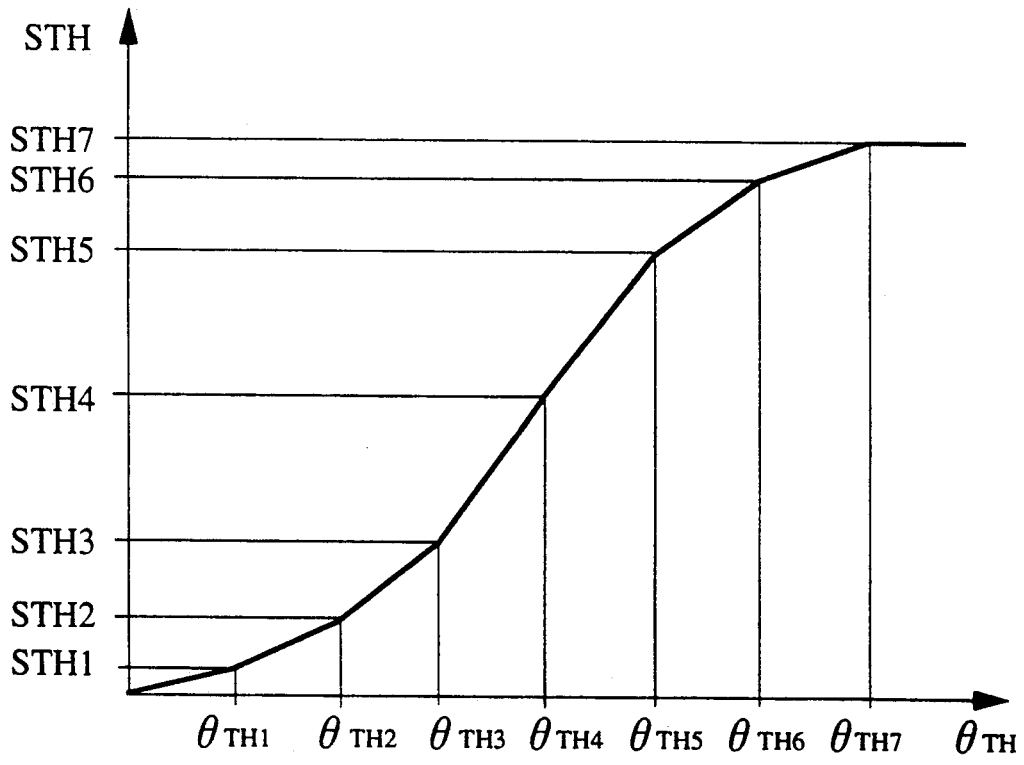
FIG. 4 is a view showing a $\theta_{TH}$-STH table.

If the answer to the question of the step S4 is affirmative (Yes), i.e. if $\theta_{TH}n <$ THWTPB, the correction coefficient KPBTH is set to a predetermined value (which is close to 0, e.g. 0.2) at a step S5. Then, at a step S6, an opening area SWOTTH (hereinafter referred to as "reference area value") formed by the throttle valve corresponding to the full load throttle valve opening HWTPB is calculated, and at a step S7, an opening area STH (hereinafter referred to as "intake air-reflecting area value) formed by the throttle valve corresponding to the present value $\theta_{TH}n$ of throttle valve opening is calculated by a $\theta_{TH}$-STH table shown in FIG. 4. In the figure, predetermined values $STH_1$ to $STH_7$ of throttle valve opening area are provided which correspond to predetermined values $\theta_{TH1}$ to $\theta_{TH7}$ of throttle valve opening, respectively. Values of throttle valve opening area corresponding to values of throttle valve opening falling between adjacent ones of the predetermined values $\theta_{TH1}$ to $\theta_{TH7}$ are calculated by interpolation. Then, at a step S8, a ratio KS of the intake air-reflecting area value STH to the reference area value SWOTTH is calculated, and at a step S9, it is determined whether or not the ratio KS is smaller than 1.0. If the answer to this question is negative (No), the ratio KS is corrected to 1.0, whereas if the answer is affirmative (Yes), the program immediately proceeds to a step S11. Although the ratio KS is naturally expected to assume a value smaller than 1.0, this fact is confirmed by the step S9.

Figure 5:
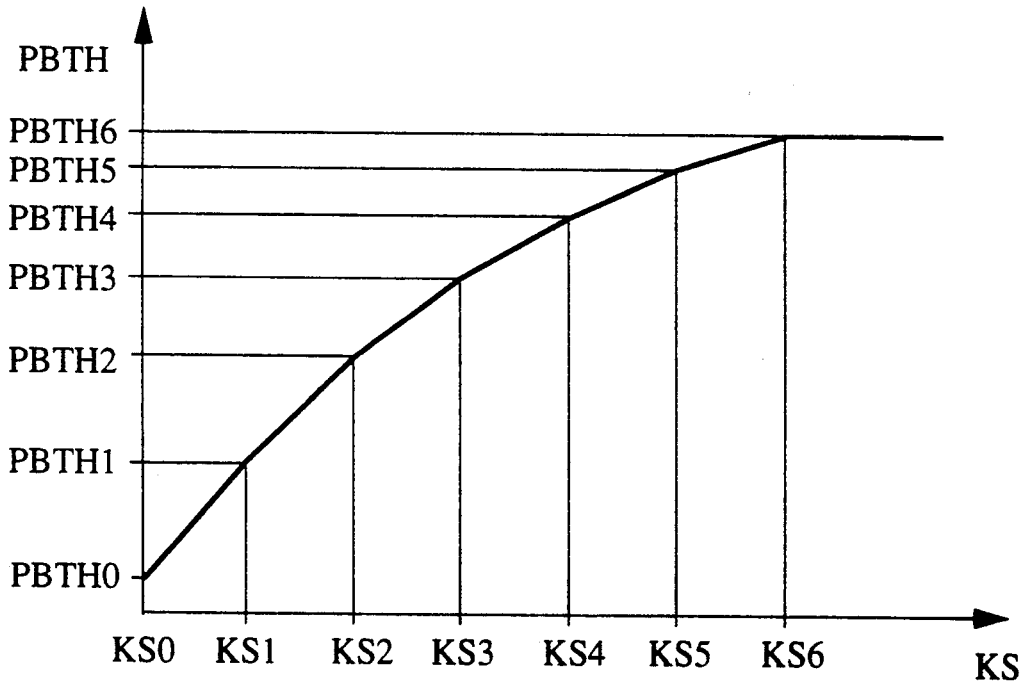
FIG. 5 is a view showing a KS-PBTH table.
Figure 6:
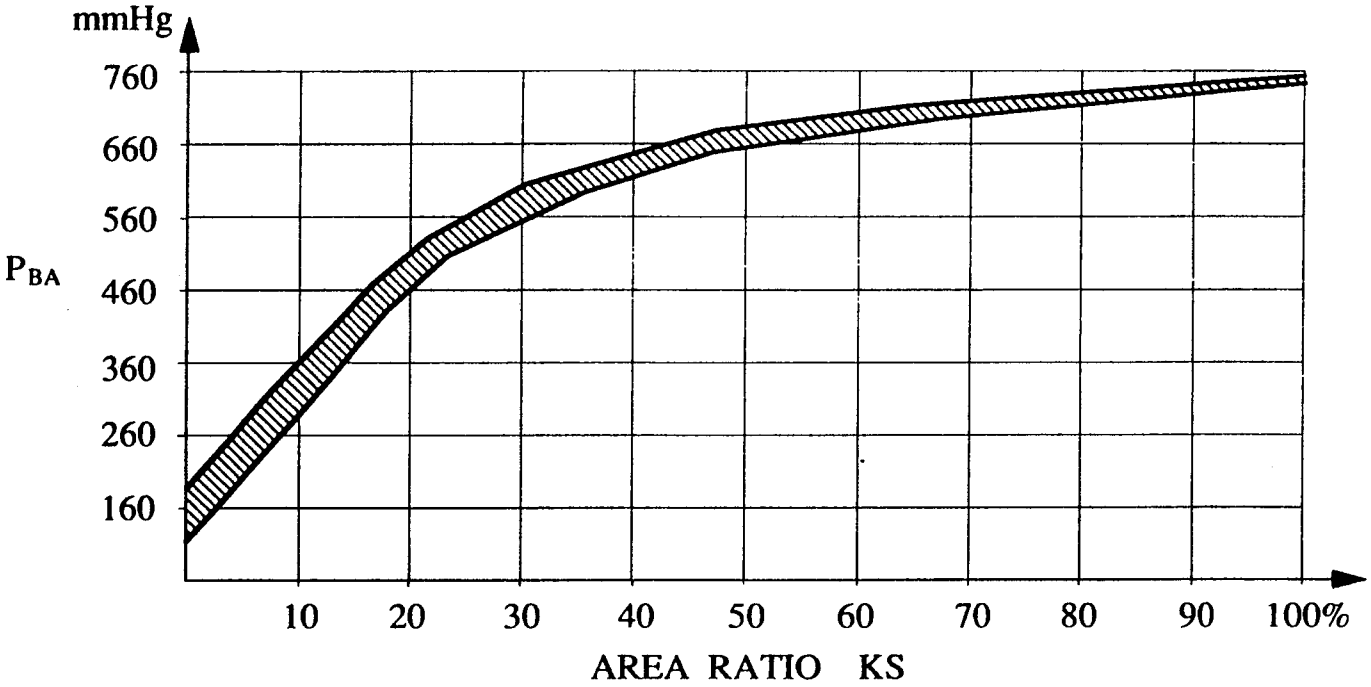
FIG. 6 is a view showing the relationship between an area ratio KS and intake pipe absolute pressure $P_{BA}$ based on actually measured values thereof.

At the step S11, an estimated $P_{BA}$ value PBTH corresponding to the ratio KS is calculated by a KS-PBTH table shown in FIG. 5. The KS-PBTH table is set based on actually measured data shown in FIG. 6. Specifically, the relationship between the ratio KS and the intake pipe absolute pressure $P_{BA}$ was actually measured at engine rotational speeds Ne of 1000, 2000, 3000, 4000, 5000, 6000, and 7000 rpm, under normal atmospheric pressure (760 mmHg). As a result, it was found that data obtained at any engine rotational speed Ne are included within a hatched area shown in FIG. 6, which means that the ratio KS and $P_{BA}$ have an approximately constant relationship irrespective of the engine rotational speed Ne. The KS-PBTH table in FIG. 5 is based on this relationship. Predetermined values PBTH0 to PBTH6 of the estimated $P_{BA}$ values are provided, which correspond to predetermined values KS0 to KS6 of the ratio KS, respectively. Values of the estimated $P_{BA}$ value corresponding to values of the ratio KS falling between adjacent ones of the predetermined values KS0 to KS6 are calculated by interpolation.

Thus, according to the present embodiment of the invention, the estimated $P_{BA}$ value is calculated based on the ratio of the intake air-reflecting area value STH to the reference area value SWOTTH, and is not dependent on the engine rotational speed Ne. Therefore, it is possible to estimate a value of intake pipe absolute pressure as an engine load parameter indicative of an amount of intake air drawn into the engine by the use of a one-dimensional table (KS-PBTH table) in which the number of data used is far smaller than the number of data used in conventional methods. It goes without saying that it is also possible to obtain the estimated $P_{BA}$ value from a map from which the estimated $P_{BA}$ value can be retrieved according to the intake air-reflecting area value STH and the reference area value SWOTTH, instead of calculating the ratio of the former to the latter, In this case as well, accurate estimation of a value of $P_{BA}$ can be effected by the map in which the number of data used is smaller than the number of data used in conventional methods.

At a step S12, the estimated $P_{BA}$ value PBTH thus obtained is corrected according to atmospheric pressure by the use of the following equation (2):

$$PBTH = PBTH - K(PAPBTH - P_A) \quad (2)$$

where PAPBTH represents normal atmospheric pressure (760 mmHg), and K a coefficient which is set, e.g. to 1.0.

Then, at a step S13, a difference between the present value $\theta_{TH}n$ of throttle valve opening and an immediately preceding value $\theta_{TH}n-1$ of same obtained in the immediately preceding loop is calculated as an amount of change DTH. It is determined at a step S14 whether or not an absolute value |DTH| of the amount of change DTH is larger than a predetermined value DTHG. If the answer to this question is negative (No), i.e., if $|DTH| \leqq DTHG$, which means that the engine is not in a transient operating condition, it is determined at a step S18 whether or not an absolute value of an amount of change $DP_{BA}$ in $P_{BA}$ is larger than a predetermined value $P_{BA}G$. The amount of change $DP_{BA}$ is calculated similarly to the amount of change DTH as a difference between the present value of $P_{BA}$ and an immediately preceding value of $P_{BA}$ obtained in the immediately preceding loop.

If the answer to the question of the step S18 is negative (No), i.e. if $|DP_{BA}| \leqq DP_{BA}G$, it is judged that the engine is in a steady operating condition, and then a difference $DPB_{cal}$ between the detected $P_{BA}$ value and the estimated $P_{BA}$ value PBTH at a step S19 is calculated, followed by the program proceeding to a step S28. The difference $DPB_{cal}$ corresponds to deviation in table values in each of the tables in FIGS. 3 to 5 due to aging of the engine, or when the engine has an additional intake passage bypassing the throttle valve, it corresponds to a deviation due to the opening area of the additional intake passage. The difference $DPB_{cal}$ is used in correction of the estimated $P_{BA}$ value at a step S15, referred to hereinafter.

If the answer to the question of the step S18 is affirmative (Yes), i.e. if $|DP_{BA}| > DP_{BA}G$, it is determined at a step S20 whether or not the flag $F_{PBTH}$ is equal to 1. If the answer to this question is negative (No), i.e. if $F_{PBTH}=0$, which means that in the immediately preceding loop, the detected $P_{BA}$ value was used in calculating the $\theta i$ value and the Ti value, the program proceeds to the step S28, where the $\theta i$ value and the Ti value are calculated by the use of the detected $P_{BA}$ valve. On the other hand, if the answer to the question of the step S20 is affirmative (Yes), i.e. if $F_{PBTH}=1$, which means that in the immediately preceding loop, the calculated $P_{BA}$ value PBATH was used in calculating the $\theta i$ value and the Ti value, the program proceeds to a step S21. When the calculated $P_{BA}$ value $P_{BATH}$ was used in the immediately preceding loop, the calculated $P_{BA}$ value $P_{BATH}$ is continuously used if the amount of change $|DP_{BA}|$ of the $P_{BA}$ value is large ($|DP_{BA}| > DP_{BA}G$), even if the amount of change |DTH| of throttle valve opening is small ($|DTH| \leqq DTHG$).

If the answer to the question of the step S14 is affirmative (Yes), i.e. if $|DTH| > DTHG$, which means that the engine is in a transient operating condition, the difference $DPB_{cal}$ calculated at the step S19 is added to the estimated $P_{BA}$ value PBTH to thereby calculate the calculated $P_{BA}$ value PBATH at a step S15, followed by the program proceeding to a step S21.

At the step S21, a different DPB between the calculated $P_{BA}$ value PBATH and the detected $P_{BA}$ value is calculated. The detected $P_{BA}$ value used in this calculation is a value of output from the intake pipe absolute pressure sensor 8. Alternatively, a $P_{BA}$ value corrected in compensation for a time lag caused by filtration of the sensor 8 or by mechanically removing pulsation of the intake air (as disclosed in Japanese Provisional Patent Publication (Kokai) No. 62-93471) may be used. When the step S21 is reached via the step S20, an immediately preceding value of the calculated $P_{BA}$ value PBATH obtained in the immediately preceding loop is used.

Then, at a step S22, it is determined whether or not the different DPB between the calculated $P_{BA}$ value PBATH and the detected $P_{BA}$ value obtained at the step S21 is larger than a predetermined positive value GPBTHP. If the answer to this question is negative (No), it is determined at a step S23 whether or not the difference DPB is smaller than a predetermined negative value GPBTHM. If both the answers to the questions of the steps S22 and S23 are negative (No), i.e. if $GPBTHM \leqq DPB \leqq GPBTHP$, it is judged that the detected $P_{BA}$ value substantially represents an actual value of the intake pipe absolute pressure, and then the program proceeds to the step S28.

On the other hand, if either the answer to the question of the step S22 or the answer to the question of the step S23 is affirmative (Yes), i.e. if $DPB > GPBTHP$ or $DPB < GPBTHM$, which means that the difference between the calculated value and the detected value is very large, the flag $F_{PBTH}$ is set to a value of 1 at a step S24, and the calculated $P_{BA}$ value PBATH is corrected at a step S25 according to the difference DPB by the following equation (3):

$$PBATH = PBATH - DPB \times KPBATH \quad (3)$$

When the amount of change |DTH| of throttle valve opening $\theta_{TH}$ is large, the calculated $P_{BA}$ value becomes slightly larger than the actual value of the intake pipe absolute pressure during acceleration of the engine (slightly smaller than the actual value during deceleration of the engine). Therefore, the correction by the equation (3) is carried out for correcting this deviation.

At the following step S26, limit checking is carried out by the use of a value of atmospheric pressure, since the calculated $P_{BA}$ value PBATH cannot be larger than the value of atmospheric pressure. Then, at a step S27, the $\theta i$ value and the Ti value are calculated by the use of the calculated $P_{BA}$ value PBATH.

Figure 7A:
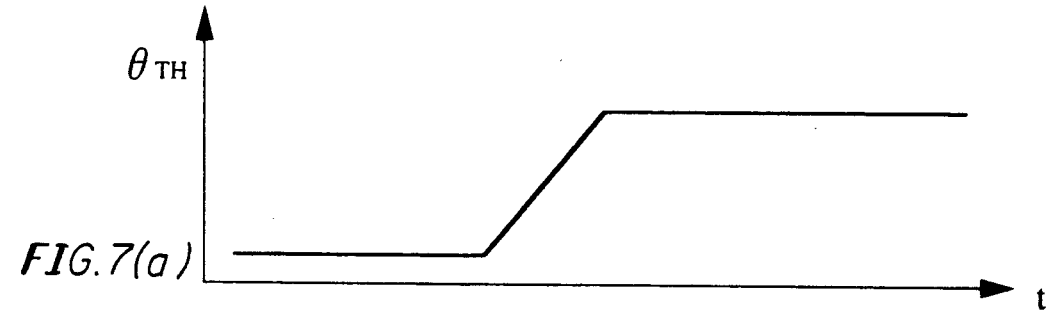
FIGS. 7(*a*)–7(*c*) are views showing changes in throttle valve opening, intake pipe absolute pressure, and air-fuel ratio during acceleration of the engine.
Figure 7B:
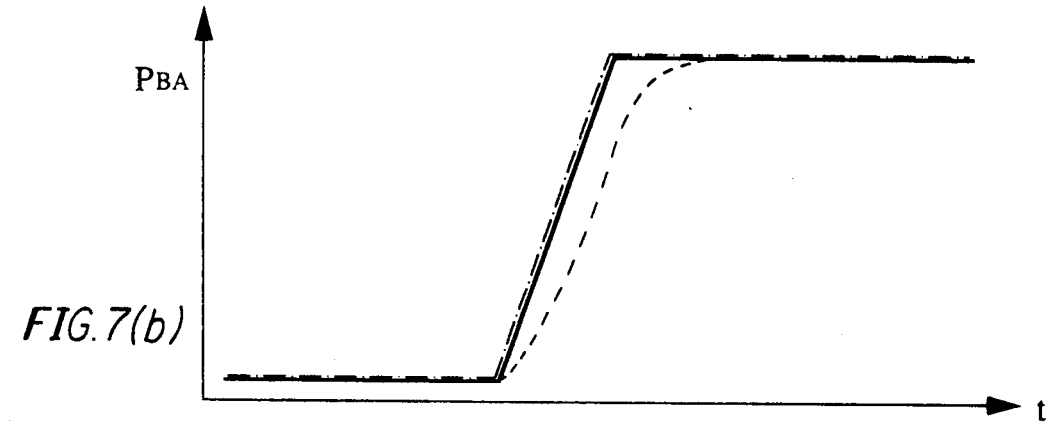
Figure 7C:
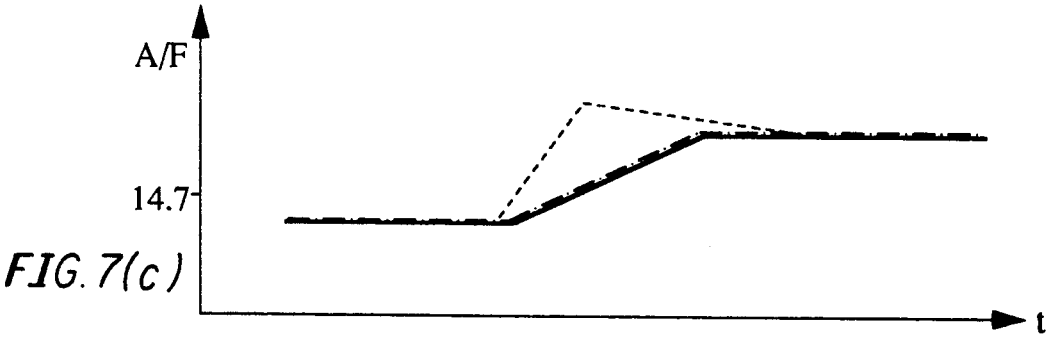

FIG. 7 shows changes in the calculated $P_{BA}$ value ((b) of the figure) and the basic air-fuel ratio A/F ((c) of same), when the throttle valve is opened ((a) of same). The one-dot-chain lines in (b) and (c) of the figure represent theoretically expected changes in the intake pipe absolute pressure and the desired value of the basic air-fuel ratio. Here, the basic air-fuel ratio is an air-fuel ratio obtained when $K_1$ of the equation (1) is set to 1 and $K_2$ of same is set to 0, i.e. when $T_{OUT}$=Ti.

The calculated $P_{BA}$ value according to the present embodiment of the invention, which is indicated by the solid line in (b) of the figure, is substantially equal to the theoretically expected value of the intake pipe absolute pressure. In contrast, the detected $P_{BA}$ value, which is indicated by the broken line, changes with a delay relative to the theoretically expected value of the intake pipe absolute pressure. Consequently, when the Ti value is calculated by the use of the detected $P_{BA}$ value, the basic air-fuel ratio A/F, as indicated by the broken line in (c) of the figure, is largely deviated toward the lean side. In contrast, when the Ti value is calculated by the use of the calculated $P_{BA}$ value, the basic air-fuel ratio A/F, as indicated by the solid line in (c) of same, is substantially equal to the desired value of the basic air-fuel ratio. Therefore, when the fuel supply is increased upon acceleration of the engine, for example, an amount of fuel to be increased can be properly determined, whereby deviation of the air-fuel ratio from a desired value can be prevented when the engine is in such a transient operating condition.

Further, according to the present embodiment, the basic value $\theta$i of ignition timing is also calculated by the calculated $P_{BA}$ value when the engine is in a transient operating condition. Therefore, the ignition timing can be properly determined.

In addition, when the engine is in a steady operating condition, the detected $P_{BA}$ value accurately represents an actual value of the intake pipe absolute pressure, so that by the use of the detected $P_{BA}$ value, accurate control of ignition timing and fuel supply can be effected.

Further, the difference $DPB_{cal}$ between the estimated $P_{BA}$ value and the detected $P_{BA}$ value is obtained when the engine is in a steady operating condition, and the calculated $P_{BA}$ value is calculated using the difference $DPB_{cal}$ when the engine is in a transient operating condition. Therefore, it is possible to eliminate adverse effects of a deviation of the estimated $P_{BA}$ value due to aging of the related component parts or those of an intake passage bypassing the throttle valve.

Although, in the above described embodiment, the engine load parameter is calculated by the use of the intake pipe absolute pressure sensed by the intake pipe absolute pressure sensor 8, this is not limitative, but it may be calculated by the use of an amount of intake air Qa which is sensed by means of an airflow meter. In such a case, the KS-PBTH table in FIG. 5 should be replaced by a KS-QatH (an estimated value of the amount of intake air) table, and a detected value of the amount of intake air should be used instead of the $P_{BA}$ value.

Further, although in the above described embodiment, first, the intake air-reflecting area value STH and the reference area value SWOTTTH are calculated based on the throttle valve opening $\theta_{TH}$ and the full load throttle valve opening HWTPB, respectively, and then the area ratio KS is calculated as STH/SWOTTH, followed by calculating the estimated $P_{BA}$ value according to the ratio KS, this is not limitative, but if the shape of the throttle valve is changed such that the relationship between the throttle valve opening and the intake air-reflecting area value is linear (e.g. a variable venturi type), the steps (steps S6 and S7) for calculating the intake air-reflecting area value can be omitted, and the estimated PBA value can be obtained using a ratio in angle between the throttle valve opening $\theta_{TH}$ and the full load throttle valve opening THWTPB.

In the present embodiment, the difference $DPB_{cal}$ between the estimated $P_{BA}$ value PBTH and the detected $P_{BA}$ value is calculated at the step S19, and the difference $DPB_{cal}$ is used for correcting the estimated $P_{BA}$ value PBTH to the calculated $P_{BA}$ value PBATH, whereby the following two deviations from the actual $P_{BA}$ value can be compensated for:

A first deviation is caused, in an arrangement where an intake passage bypassing the throttle valve is provided, when the opening of a control valve provided in the intake passage bypassing the throttle valve is increased. A second deviation is caused due to carbon attached to the throttle valve and associated component parts thereof in the course of long term service, which substantially decreases the intake air-reflecting area value. The first deviation can also be compensated for by storing in advance changes in the intake pipe absolute pressure resulting from degrees of opening of the control valve provided in the intake passage bypassing the throttle valve, in a table of correction values, and correcting the estimated PBA value by the use of the correction values in accordance with detected values of opening of the control valve (or an instruction signal for opening the control valve). Therefore, the correction at step S15 may be effected by the use of such a table of correction values instead of using the difference $DPB_{cal}$. However, in this case as well, the compensation for the second deviation must be carried out, as in the present embodiment, by the use of the difference between the detected $P_{BA}$ value and the estimated $P_{BA}$ value, which is calculated when the engine is in a steady operating condition.

Furthermore, although, in the present embodiment, the correction coefficient KPBTH for use in the step S25 is set to a predetermined value except when the throttle valve is fully opened (the answer to the question of the step S4 is negative (No)), this is not limitative, but it may be set to different values depending on whether the the engine is accelerating or decelerating, or may be varied depending on the engine coolant temperature.

What is claimed is:

1. An engine load parameter-calculating system for an internal combustion engine having an intake passage, and a throttle valve arranged in said intake passage, said system calculating an engine load parameter indicative of an amount of intake air drawn into said engine;

said system comprising:

opening area value-determining means for determining a value of an opening area formed by said throttle valve;

reference area value-determining means for determining a reference value of said opening area formed by said throttle valve in accordance with a rotational speed of said engine; and engine load parameter-determining means for determining a value of said engine load parameter from said value of said opening area formed by said throttle valve and said reference value of said opening area formed by said throttle valve.

2. An engine load parameter-calculating system according to claim 1, wherein said engine load parameter-determining means includes area ratio-calculating means for calculating a ratio between said value of said opening area formed by said throttle valve and said reference value, said value of said engine load parameter being determined based on said ratio.

3. An engine control system for an internal combustion engine including an intake passage, a throttle valve arranged in said intake passage, and an engine load parameter-calculating system for calculating an engine load parameter indicative of an amount of intake air drawn into said engine, said engine load parameter-calculating system including:

opening area value-determining means for determining a value of an opening area formed by said throttle valve;

reference area value-determining means for determining a reference value of said opening area formed by said throttle valve in accordance with a rotational speed of said engine; and engine load parameter-determining means for determining a value of said engine load parameter from said value of said opening area formed by said throttle valve and said reference value of said opening area formed by said throttle valve;

said engine control system comprising basic control amount-calculating means for calculating a basic control amount for controlling said engine by the use of said value of said engine load parameter determined by said engine load parameter-determining means.

4. An engine control system according to claim 3, wherein said engine load parameter-determining means includes area ratio-calculating means for calculating a ratio between said value of said opening area formed by said throttle valve and said reference value of said opening area formed by said throttle valve, said value of said engine load parameter being determined based on said ratio.

5. An engine control system according to claim 3 or 4, including an engine load sensor for detecting said engine load parameter, and transient operating condition-determining means for determining whether or not said engine is in a transient operating condition, and wherein said basic control amount-calculating means calculates said basic control amount by the use of a value of output from said engine load sensor when said transient operating condition-determining means has determined that said engine is not in said transient operating condition.

6. An engine control system according to claim 5, wherein said engine load sensor detects pressure within said intake passage at a location downstream of said throttle valve.

7. An engine control system according to claim 5, wherein said engine load sensor detects an amount of air drawn into said engine.

8. An engine control system according to claim 5, including difference-calculating means for calculating a difference between a value of output from said engine load sensor and said value of said engine load parameter determined by said engine load parameter-determining means, when said transient operating condition-determining means has determined that said engine is not in said transient operating condition, and wherein said basic control amount-calculating means corrects said value of said engine load parameter determined by said engine load parameter-determining means, by said difference for calculating said basic control amount, when said transient operating condition-determining means has determined that said engine is in said transient operating condition.

9. An engine load parameter-calculating system for an internal combustion engine having an intake passage and a throttle valve arranged in said intake passage, said system calculating an an engine load parameter indicative of an amount of intake air drawn into said engine, said system comprising:

throttle valve opening-detecting means for detecting a value of angle assumed by said throttle valve;

reference value-determining means for determining a reference value of said angle of said throttle valve in accordance with a rotational speed of said engine; and engine load parameter-determining means for determining a value of said engine load parameter indicative of said amount of intake air, from the detected value of said angle assumed by said throttle valve and said reference value of said angle assumed by said throttle valve.

10. An engine load parameter-calculating system according to claim 9, wherein said engine load parameter-determining means includes means for calculating a ratio between said value of said angle assumed by said throttle valve and said reference value of said angle assumed by said throttle valve, said engine load parameter being determined based on said ratio.

11. An engine control system for an internal combustion engine including an intake passage, a throttle valve arranged in said intake passage, and an engine load parameter-calculating system for calculating an engine load parameter indicative of an amount of intake air drawn into said engine, said engine load parameter-calculating system including:

throttle valve opening-detecting means for detecting a value of angle assumed by said throttle valve;

reference value-determining means for determining a reference value of said angle of said throttle valve in accordance with a rotational speed of said engine; and engine load parameter-determining means for determining a value of value of said engine load parameter indicative of said amount of intake air, from the detected valve of said angle assumed by said throttle valve and said reference value of said angle assumed by said throttle valve;

said engine control system comprising basic control amount-calculating means for calculating a basic control amount for controlling said engine by the use of said value of said engine load parameter obtained by said engine load parameter-determining means.

* * * * *